United States Patent [19]

Hertel

[11] 4,053,256

[45] Oct. 11, 1977

[54] VARIABLE CAMBER VANE FOR A GAS TURBINE ENGINE

[75] Inventor: John Edward Hertel, East Hartford, Conn.

[73] Assignee: United Technologies Corporation, Hartford, Conn.

[21] Appl. No.: 617,921

[22] Filed: Sept. 29, 1975

[51] Int. Cl.[2] ..... F01D 9/02; F01D 9/00

[52] U.S. Cl. ..... 415/161; 415/160

[58] Field of Search ..... 415/149, 160, 161, 162, 415/137

[56] References Cited

U.S. PATENT DOCUMENTS

| | | | |
|---|---|---|---|
| 2,316,452 | 4/1943 | Pfenninger | 415/161 |
| 2,805,818 | 9/1957 | Ferri | 415/161 |
| 2,841,325 | 7/1958 | Weise | 415/161 |
| 3,318,574 | 5/1967 | Tyler | 415/161 |
| 3,538,579 | 11/1970 | Sprenger | 415/160 |
| 3,568,650 | 3/1971 | Albrich | 415/160 |
| 3,674,377 | 7/1972 | Trappmann | 415/160 |
| 3,887,297 | 6/1975 | Welchek | 415/161 |

FOREIGN PATENT DOCUMENTS

| | | | |
|---|---|---|---|
| 614,179 | 2/1961 | Canada | 415/160 |

*Primary Examiner*—Carlton R. Croyle
*Assistant Examiner*—L. J. Casaregola
*Attorney, Agent, or Firm*—Robert C. Walker

[57] ABSTRACT

Apparatus for controlling the direction of flow of the working medium gases in the compression section of a gas turbine engine is disclosed. Vanes are disposed across the flow path for the medium gases to direct the flow to a preferred downstream angle. In one embodiment vanes are disposed across the compressor exit passage. The camber of the vanes at the compressor exit is variable in response to engine operating conditions to conform the flow to a fixed optimum angle of entry into the combustion section.

5 Claims, 3 Drawing Figures

VARIABLE CAMBER VANE FOR A GAS TURBINE ENGINE

BACKGROUND OF THE INVENTION

1. Field of the Invention

This invention relates to gas turbine engines and more particularly to engines having a variable geometry compression section.

2. Description of the Prior Art

In a gas turbine engine of the type referred to above, working medium gases are compressed by a first series of rotor mounted blades in a compression section and are flowed axially downstream to a combustion section. Fuel is combined with the compressed gases and burned in a combustion section to add thermal energy to the flowing medium. Downstream of the combustion section the medium gases are flowed across a second series of rotor mounted blades which are located in the turbine section. The second series of blades extract sufficient energy from the flowing gases to drive the blades of the compression section.

In an axial flow engine the blades of the compression section are arranged in rows which extend radially outward from the rotor into the working medium flow path. A compressor case surrounds the blades and the rotor. Rows of compressor vanes are circumferentially disposed across the flow path radially inward of the case between each pair of adjacent blade rows. Each row of vanes directs the medium gases discharging from the immediately upstream row of blades to a preferred angle of entry into the immediately downstream row of blades. The preferred angle of entry into each row of blades varies according to the speed of rotation of the rotor and the velocity vector of the medium gases approaching the blades.

Modern compressors having optimized flow characteristics contain vanes within the compressor section which are rotatably mounted with respect to the compressor case for conforming the flow thereacross to a preferred angle of entry into the downstream blades irrespective of the rotor speed or the velocity vector of the gases at any particular operating condition. Compression sections of this type are well known within the art and are termed "variable geometry compressors". Variable geometry compressors are more fully discussed in U.S. Pat. No. 2,805,818 to Ferri entitled "Stator of Axial Flow Compressor with Supersonic Velocity at Entrance", U.S. Pat. No. 2,999,630 to Warren et al entitled "Compressor", and U.S. Pat. No. 3,873,230 to Norris et al. entitled "Stator Vane Actuating Mechanism".

Conventionally, the flow discharging from the last row of compressor blades has a tangential velocity within the flow path which is in the direction of rotation of the rotor. A row of vanes is positioned downstream of the last row of blades to redirect the medium gases flowing thereacross to an essentially axial direction as the flow approaches the combustion section. Apertures at the upstream end of a combustion chamber within the combustion section are fixedly oriented to accept flow from the axial direction in the attainment of optimum combustion characteristics. Accordingly, the last row of vanes upstream of the combustion section is fixed relative to the flow path so as to discharge the flow axially into the combustion section regardless of the engine operating conditions.

Continuing efforts are underway to effect aerodynamic improvements in the flow of air from the compression section to the combustion section of a gas turbine engine while maintaining characteristics which are consonant with optimum operation in the combustion section.

SUMMARY OF THE INVENTION

A primary object of the present invention is to improve the performance of a gas turbine engine by directing the working medium gases flowing through the engine to a preferred angle within the flow path. More specifically, it is an object to direct the medium gases to the single preferred angle irrespective of the engine operating conditions. Further objects are to provide variable camber vanes which are rotatably alignable with the direction of flow of the approaching working medium gases and to provide vanes having minimized susceptibility to thermally initiated damage.

According to the present invention a variable geometry vane has a leading edge element which is rotatably cantilevered from the outer wall of the flow path and a trailing edge element which is fixed relative to the flow path at a location downstream of the leading edge element.

A primary feature of the present invention is the leading edge element of the vane which is rotatably cantilevered from the outer wall of the flow path for the working medium gases. In one embodiment the trailing edge element of the vane is fixedly cantilevered from the inner wall of the flow path. A circular vane platform at the outer wall supports each leading edge element along the full chord length of the element. The center of rotation of the leading edge element is coincident with the geometric center of the corresponding platform and, in one embodiment, is positioned at forty percent (40%) of the chord length of the vane from the upstream edge of the element.

A principal advantage of the present invention is minimized flow losses imposed upon the medium gases by the described apparatus in conforming the flow across the vane to a fixed discharge angle at varied engine operating conditions. The sensitivity of the combustion process to off optimum operation of an engine having a high Mach Number compressor is reduced by deploying the described variable vane across the exit passage from the compressor. The structural rigidity of the leading edge element is maintained and the leakage of medium gases between the outer wall of the flow path and the element is prevented by supporting the element from the circular platform along the full chord of the leading edge element. In one embodiment the susceptibility of the apparatus to thermally initiated damage is reduced by cantilevering the trailing edge element from the inner wall of the working medium flow path so as to allow uninhibited relative differential growth between the inner and outer walls of the flow path and between the leading and trailing edge elements of the vane.

The foregoing, and other objects, features and advantages of the present invention will become more apparent in the light of the following detailed description of the preferred embodiment thereof as shown in the accompanying drawing.

DESCRIPTION OF THE PREFERRED EMBODIMENT

Figure 1:
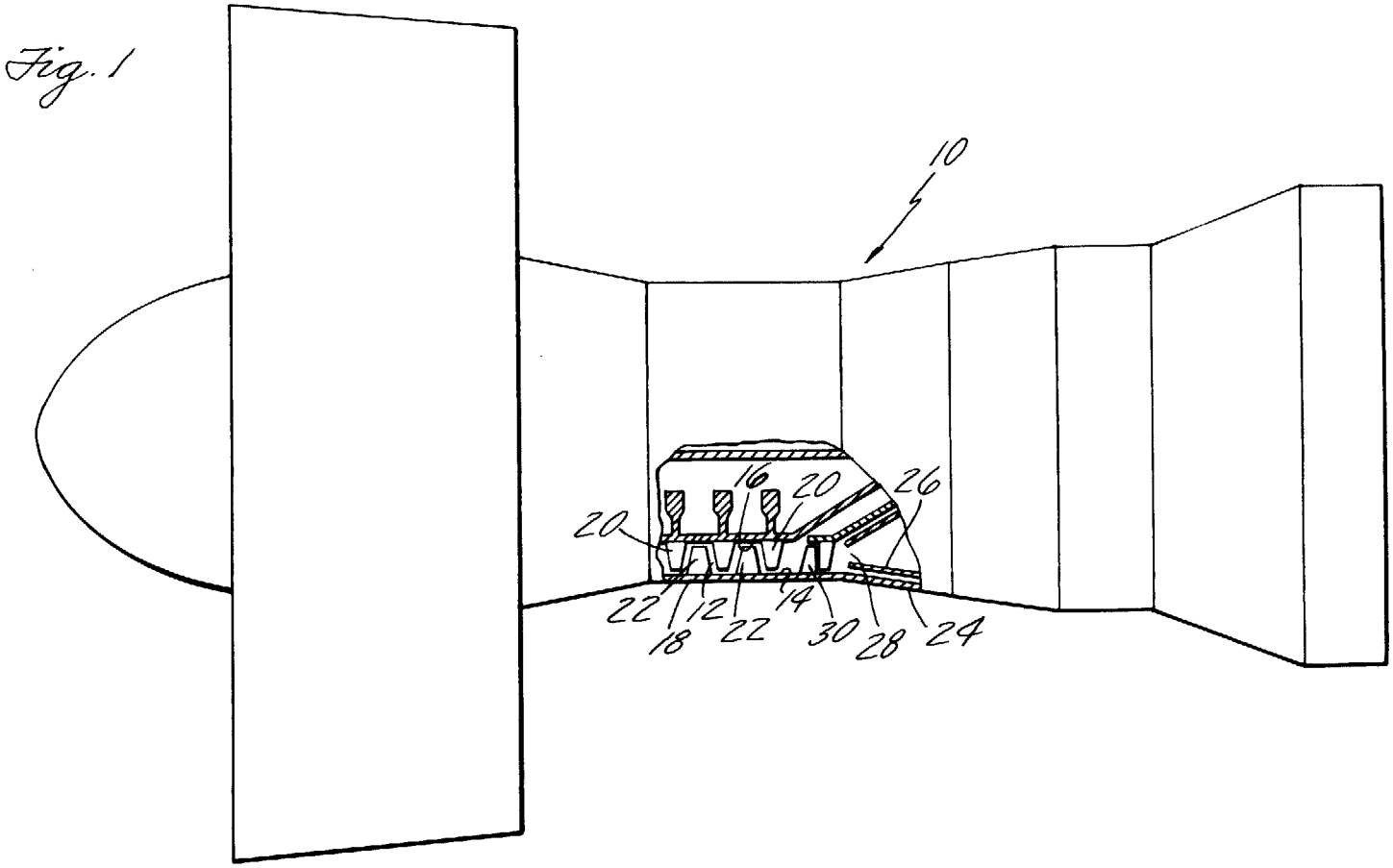
FIG. 1 is a simplified side elevation view of a typical gas turbine engine which is partially broken away to show the flow path for the working medium gases in the compressor exit region.

A typical gas turbine engine 10, as shown in FIG. 1, has a flow path 12 extending axially through the engine for the working medium gases. The flow path is bounded radially by an outer wall 14 and an inner wall 16. At the upstream end of the flow path, a compression section 18 raises the pressure of the medium gases by pumping the gases through a series of alternating rotor blades 20 and stator vanes 22. The gases discharging from each rotor blade 20 have a tangential velocity component in the direction of rotation of the blades. Each downstream vane 22 redirects the gases flowing thereacross to a preferred angle within the flow path for entry into the succeeding blades 20. The preferred angle of entry varies with the engine operating conditions and the vanes 22 are commonly rotatable to provide that preferred angle.

Disposed along the flow path 12 downstream of the compression section 18 is a combustion section 24 having a combustor 26. The combustor 26 is conventionally fixed relative to the flow path and contains one or more apertures 28 at its upstream end through which the medium gases are admitted to the combustor. The optimum angle of flow into the combustor is fixed with each engine and does not vary with changes in the engine operating condition.

Figure 2:
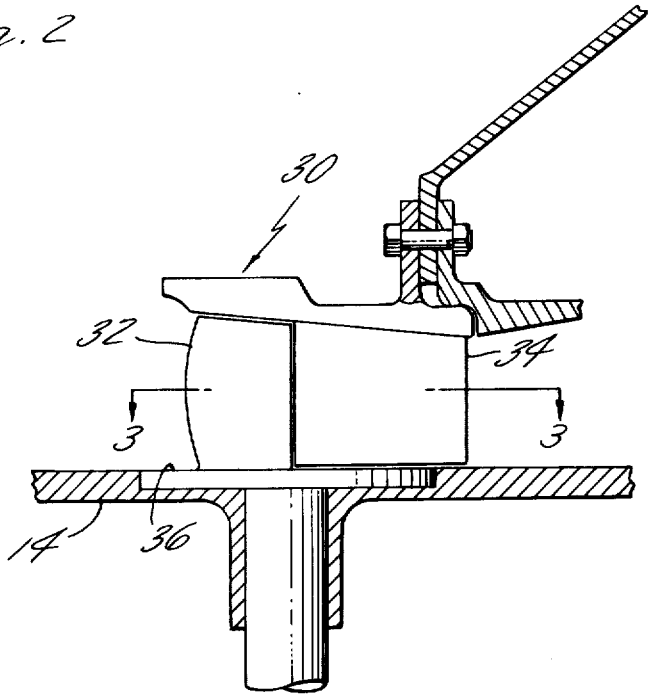
FIG. 2 is an enlarged view of the compressor exit region of FIG. 1.
Figure 3:
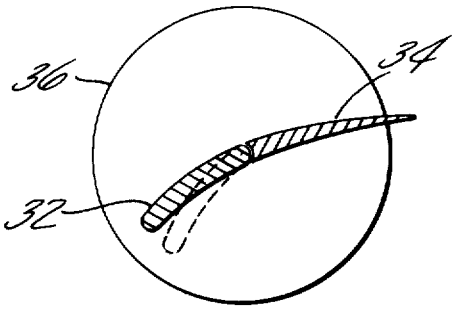
FIG. 3 is a section view taken along the line 3—3 as shown in FIG. 2.

A compressor exit vane 30 is disposed across the flow path between the combustion section 24 and the last rotor blade 20 of the compression section 18 to conform the direction of flow from the compression section to the preferred angle of entry into the combustor 26. An enlarged view of the exit vane 30 is shown in FIG. 2. The vane has a leading edge element 32 which is rotatably mounted from the outer wall 14 of the flow path and a trailing edge element 34 which is fixedly mounted downstream of the leading edge element. A leading edge platform 36 which is circular in cross section is integrally mounted within the outer wall 14 and is rotatable with respect thereto. The leading edge element 32 is attached to the platform along the entire chord length of the element 32.

During operation of the engine the working medium gases are flowed axially downstream across the compressor exit vane 30. The angle of entry of the medium gases into the vane largely dependent upon the speed of the rotor which, through the immediately upstream rotor blade 20, imparts a tangential velocity component to the gases flowing across the blade. Flow losses at the leading edge of the vane 30 are minimized in the described construction by aligning the leading edge element 32 with the direction of the incoming flow. Aligning the leading edge element changes the camber on the vane so as to provide aerodynamically efficient redirection of the flow. As the engine operating conditions are varied, the leading edge element is correspondingly realigned to maintain efficient redirection.

The combustor 26 is fixed within the flow path axially downstream of the vane 30. the optimum angle of entry for flow into the upstream end of the combustor is accordingly fixed, that is, does not vary with engine operating conditions. The trailing edge element 34 is fixedly aligned with the optimum entry angle to the combustor to minimize flow losses at the combustor aperture 28. Notwithstanding rotational variations in the leading edge element 32, the trailing edge element remains fixed to insure that the entry angle remains constant throughout the engine operating ranges.

The apparatus described herein is effective when used in conjunction with a swirl combustion chamber of the type shown in U.S. Pat. No. 3,788,065 entitled "Annular Combustion Chamber for Dissimilar Fluids in Swirling Flow Relationship" to Markowski, or when used in conjunction with more conventional combustion chambers such as the type shown in U.S. Pat. No. 3,372,542 entitled "Annular Burner for a Gas Turbine Engine" to Sevetz. Combustion chambers in general are sensitive to the direction of the incoming flow and operate less efficiently as the entry angle deviates from the optimum design condition. The sensitivity is particularly acute in engine constructions employing high Mach Number compressors upstream of the combustion chamber. In one particular construction the flow is efficiently conformed from varied entry angles to fixed discharge angles by the variable camber vane 30 at flow Mach Numbers across the vane which vary within the range of (0.45) to (0.75). Furthermore it is expected that efficient operation at Mach numbers greater than (0.75) will continue to occur.

The leading edge element 32 of the vane 30 is cantilevered from the outer wall 14 of the flow path. In the embodiment shown the element 32 extends radially inward from the leading edge platform 36. The platform has a circular cross section, is recessed into the outer wall 14 and is rotatable with respect to the outer wall. The center of rotation of the element 32 is coincident with the geometric center of the platform 36. A center of rotation of the element 32 at approximately (40%) along the vane chord length from the leading edge provides particularly effective variable camber geometry with minimized frictional flow losses.

The trailing edge element 34 is rotatably fixed relative to the outer wall 14 and the inner wall 12. In the embodiment shown the element 34 is cantilevered from the inner wall 12 and extends across the flow path into close proximity with the outer wall 14. In some constructions it may be advantageous to join the element 34 to both flow path walls or to cantilever the element 34 from the outer wall. The cantilevered embodiment, however, is particularly advantageous in that relative axial or radial movement between the two walls in response to varying thermal conditions is uninhibited by the vanes disposed therebetween. Concomitantly, adverse thermal stresses are not imparted to the vanes by the thermally responding walls.

The variable camber vane described herein is shown at the exit passage from the compressor where the characteristics of the vane are used to particular advantage. The described construction, however, may also be employed where similar flow entering and discharge characteristics are required.

Although the invention has been shown and described with respect to a preferred embodiment thereof, it should be understood by those skilled in the art that various changes and omissions in the form and detail thereof may be made therein without departing from the spirit and the scope of the invention.

Having thus described a typical embodiment of our invention, that which we claim as new and desire to secure by Letters Patent of the United States is:

1. Apparatus for directing the medium gas within the flow path of a gas turbine engine to a preferred angle within the flow path, comprising:

a variable camber vane having a leading edge element which is rotatably cantilevered from the outer wall of the flow path and a trailing edge element which is rotatably fixed relative to the outer wall at a point downstream of the leading edge element, wherein said leading and trailing edge elements are cooperatively disposed to form the vane and wherein the trailing edge element is cantilevered from the inner wall of the medium flow path.

2. The invention according to claim 1 wherein the leading element is rotatably alignable with the direction of flow of the working medium gases approaching said vane.

3. The invention according to claim 1 wherein the leading edge element extends radially inward from a circular platform which is recessed into the outer wall, said platform structurally supporting the leading edge element and preventing the leakage of working medium gases between the element and the outer wall.

4. The invention according to claim 1 wherein the leading edge element is rotatably mounted about a point which is at approximately (40%) of the vane chord length from the upstream end of the airfoil section.

5. The invention according to claim 1 wherein said vane is positioned between the compression section and the combustion section of an axial flow, gas turbine engine.

* * * * *